US012098337B2

(12) United States Patent
Spicer et al.

(10) Patent No.: US 12,098,337 B2
(45) Date of Patent: Sep. 24, 2024

(54) CONDUITS FOR COOLING A HYDROCARBON GAS-CONTAINING STREAM AND PROCESSES FOR USING SAME

(71) Applicant: ExxonMobil Chemical Patents Inc., Baytown, TX (US)

(72) Inventors: David Spicer, Houston, TX (US); James C. Slonaker, Baytown, TX (US); Thomas T. Hirst, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 67 days.

(21) Appl. No.: 17/933,774

(22) Filed: Sep. 20, 2022

(65) Prior Publication Data

US 2023/0094752 A1 Mar. 30, 2023

Related U.S. Application Data

(60) Provisional application No. 63/250,262, filed on Sep. 30, 2021.

(51) Int. Cl.
*C10G 9/00* (2006.01)
*F28C 3/06* (2006.01)
(Continued)

(52) U.S. Cl.
CPC ..... *C10G 9/002* (2013.01); *F28C 3/06* (2013.01); *F28D 7/106* (2013.01); *F28F 1/003* (2013.01);
(Continued)

(58) Field of Classification Search
CPC . C10G 9/002; F28C 3/06; F28D 7/106; F28D 7/16; F28D 2021/0059;
(Continued)

(56) References Cited

U.S. PATENT DOCUMENTS 3,593,968 A 7/1971 Geddes
3,758,081 A * 9/1973 Prudhon ..... F28C 3/06 261/118
(Continued)

FOREIGN PATENT DOCUMENTS

GB 1233795 A 5/1971

OTHER PUBLICATIONS

H. Herrmann & W. Burghardt, "Latest Developments in Transfer Line Exchanger Design for Ethylene Plants", Apr. 1994, Schmidt'sche Heissdampf-Gesellschaft Prepared for presentation at AIChE Spring National Meeting, Atlanta Paper #23C.

*Primary Examiner* — Eric S Ruppert
*Assistant Examiner* — Hans R Weiland

(57) ABSTRACT

Conduits for cooling a hydrocarbon stream and processes for using same. The conduit can include a first inner wall defining a first bore, a second inner wall defining a second bore, and an outer wall disposed about the first and second inner walls. The conduit can also include an annular support wall connected to an inner surface of the outer wall. An end of the second inner wall and an end of the annular support wall can define a perimeter opening that can be in fluid communication with the second bore. An annular flexible ring can be bonded to the annular support wall and can flexibly contact the first inner wall. A substantially annular cavity can be disposed between the second inner and the outer walls and in fluid communication with the perimeter opening. A quench fluid introduction port can be configured to introduce a quench fluid into the cavity.

28 Claims, 3 Drawing Sheets

(51) Int. Cl.

| | |
|---|---|
| ***F28D 7/10*** | (2006.01) |
| ***F28F 1/00*** | (2006.01) |
| *F28D 7/16* | (2006.01) |
| *F28D 21/00* | (2006.01) |

(52) U.S. Cl.
CPC ..... *F28D 7/16* (2013.01); *F28D 2021/0059* (2013.01); *F28F 2230/00* (2013.01); *F28F 2255/02* (2013.01)

(58) Field of Classification Search
CPC ..... F28D 2021/0075; F28F 1/003; F28F 2230/00; F28F 2255/02; F28F 2265/26
See application file for complete search history.

(56) References Cited

U.S. PATENT DOCUMENTS

| | | | | |
|---|---|---|---|---|
| 3,907,661 | A | 9/1975 | Gwyn et al. | |
| 3,959,420 | A * | 5/1976 | Geddes | B01J 19/0013 261/DIG. 54 |
| 4,121,908 | A | 10/1978 | Raab et al. | |
| 4,444,697 | A | 4/1984 | Gater et al. | |
| 5,358,262 | A * | 10/1994 | Roberts | F16J 15/22 87/8 |
| 6,626,424 | B2 | 9/2003 | Ngan et al. | |
| 8,177,200 | B2 * | 5/2012 | Spicer | C10G 9/00 261/153 |

* cited by examiner

CONDUITS FOR COOLING A HYDROCARBON GAS-CONTAINING STREAM AND PROCESSES FOR USING SAME

CROSS-REFERENCE TO RELATED APPLICATION

This application claims the benefit of U.S. Provisional Patent Application 63/250,262 filed Sep. 30, 2021 entitled "CONDUITS FOR COOLING A HYDROCARBON GAS-CONTAINING STREAM AND PROCESSES FOR USING SAME," the entirety of which is incorporated by reference herein.

FIELD

Embodiments disclosed herein generally relate to conduits for cooling a hydrocarbon gas-containing stream and processes for using same.

BACKGROUND

Light olefins, e.g., ethylene, propylene, and butenes, are typically produced by cracking relatively light hydrocarbon feeds such as ethane, propane, butane, and naphthas and/or relatively heavy hydrocarbon feeds, such as gas-oils and crude-oils, utilizing pyrolysis, e.g., steam cracking. The cracked effluent or hydrocarbon gas-containing stream needs to be quenched or cooled shortly after leaving the pyrolysis furnace to prevent the cracking reactions from continuing past the point of product generation. Quenching cracked effluent streams produced from relatively heavy hydrocarbon feeds such as gas-oils and/or crude-oils presents certain challenges to prevent the deposition of what is variously referred to as tar, pitch, or non-volatiles and related fouling problems within the quench equipment. As the cracked effluent stream is cooled, the stream will eventually reach a temperature (the effluent dew-point) at which the heaviest cracked by-product components begin to condense. Such molecules have extremely high viscosity in the absence of a fluxant or solvent liquid and are still highly reactive at the temperatures at which the molecules first condense. If condensed against a relatively hot tube wall, the initial condensation products can continue to cross-link, polymerize and/or dehydrogenate to form a highly insulative foulant or coke layer. This concept is sometimes referred to in the industry as "dew-point fouling".

To mitigate tar deposition and reduce fouling, quench fluid has been introduced directly into the cracked effluent stream. Direct quench is commonly performed by introduction of the quench fluid into the cracked effluent stream through the tube wall that can be dispersed through gravity, fluid shear, and/or mechanical dispersion during introduction. For example, direct quench can be conducted by dispersing the quench fluid directly onto the tube wall. Significant drawbacks to such direct quench systems are that a high volume of the quench fluid is required that also requires high separation and treatment volumes and costs. Pipe sizing also needs to be increased to accommodate such volumes. On commercial sized crackers, this can result in undesirably large circulation pumps, pipe work, cost, and energy consumption. Additionally, due to the difficulty in controlling the physical dispersion of the injected quench fluid within the cracked effluent stream, not only are large amounts of quench fluid used, but the introduction systems also can require inertial dispersion, spraying, or some other type of voluminous and energetic introduction process to attempt adequate dispersion and mixing to directly quench the cracked effluent stream. An additional and serious operation problem with dispersion fittings is the propensity of the small openings in the nozzles to plug with polymer and coke particles and/or structural deformation near the injection of the quench fluid due to the formation of coke.

There is a need, therefore, for improved conduits for cooling a hydrocarbon gas-containing stream and processes for using same. This disclosure satisfies this and other needs.

SUMMARY

Conduits for cooling a hydrocarbon gas-containing stream and processes for using same are provided. In some embodiments, the conduit for cooling a hydrocarbon gas-containing stream can include (i) a first inner wall that can have a first inner surface that defines a first bore therethrough, a second inner wall that can have a second inner surface that defines a second bore therethrough, and an outer wall disposed about the first inner wall and the second inner wall. The conduit can also include (ii) an annular support wall that can have a first end connected to an inner surface of the outer wall and a second end that can be proximate to an outer surface of the first inner wall such that an annular gap is formed between the second end of the annular support wall and the outer surface of the first inner wall. A first end of the second inner wall and the second end of the annular support wall can define a perimeter opening that can be in fluid communication with the second bore. The conduit can also include (iii) an annular flexible ring that can have an outer perimeter, an inner perimeter, and a continuous ring wall between the outer perimeter and the inner perimeter. The outer perimeter can be bonded to the second end of the annular support wall. The inner perimeter can flexibly contact the outer surface of the first inner wall without forming a permanent mechanical bond with the first inner wall, thereby permitting the first inner sidewall to thermally change dimensions both radially and axially with respect to a longitudinal axis of the first bore. The conduit can also include (iv) a substantially annular cavity disposed between the second inner wall and the outer wall. The annular cavity can be in fluid communication with the perimeter opening via a peripheral channel. The conduit can also include (v) at least one quench fluid introduction port that can be configured to introduce a quench fluid into the annular cavity.

In other embodiments, the process for quenching a hydrocarbon gas-containing stream can include (I) introducing the hydrocarbon gas-containing stream into a first bore of a cooling conduit. The cooling conduit can include (i) a first inner wall that can have a first inner surface that defines a first bore therethrough, a second inner wall that can have a second inner surface that defines a second bore therethrough, and an outer wall disposed about the first inner wall and the second inner wall. The conduit can also include (ii) an annular support wall that can have a first end connected to an inner surface of the outer wall and a second end that can be proximate to an outer surface of the first inner wall such that an annular gap is formed between the second end of the annular support wall and the outer surface of the first inner wall. A first end of the second inner wall and the second end of the annular support wall can define a perimeter opening that can be in fluid communication with the second bore. The conduit can also include (iii) an annular flexible ring that can have an outer perimeter, an inner perimeter, and a continuous ring wall between the outer perimeter and the inner perimeter. The outer perimeter can be bonded to the second end of the annular support wall. The inner perimeter can flexibly contact the outer surface of the first inner wall without forming a permanent mechanical bond with the first inner wall, thereby permitting the first inner sidewall to thermally change dimensions both radially and axially with respect to a longitudinal axis of the first bore. The conduit can also include (iv) a substantially annular cavity disposed between the second inner wall and the outer wall. The annular cavity can be in fluid communication with the perimeter opening via a peripheral channel. The conduit can also include (v) at least one quench fluid introduction port that can be configured to introduce a quench fluid into the annular cavity. The process can also include (II) introducing a quench fluid into the substantially annular cavity via the at least one quench fluid introduction port. The process can also include (III) flowing the quench fluid through the peripheral channel to the perimeter opening. The process can also include (IV) distributing the quench fluid from the perimeter opening onto the second inner surface of the second inner wall. The process can also include (V) flowing the hydrocarbon gas-containing stream from the first bore into the second bore. The process can also include (VI) contacting the hydrocarbon gas-containing stream with the quench fluid within the second bore to produce a cooled effluent.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
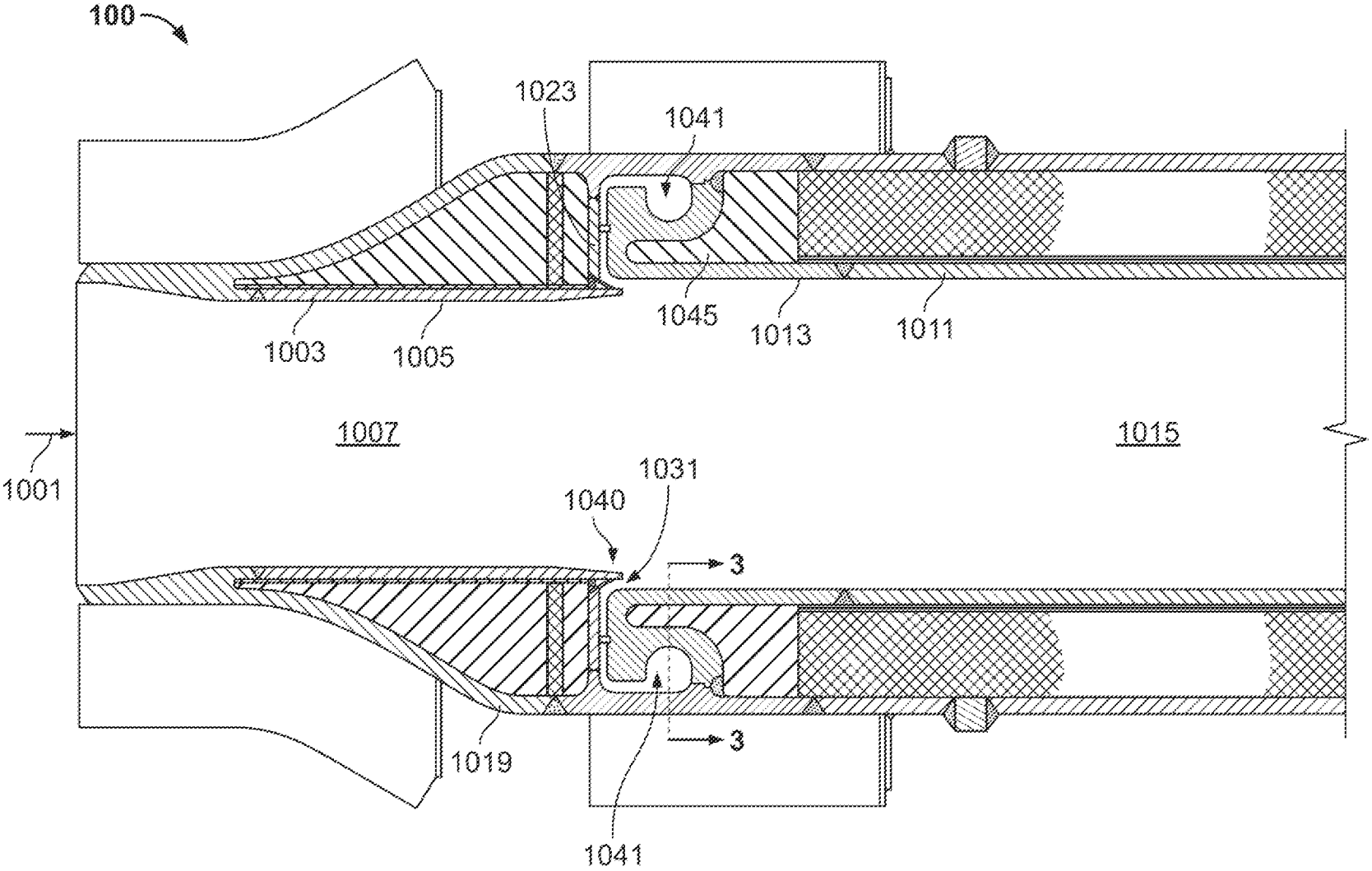
FIG. 1 depicts a longitudinal cross-section view of a conduit for cooling a hydrocarbon gas-containing effluent, according to one or more embodiments described.

It is to be understood that the following disclosure describes several exemplary embodiments for implementing different features, structures, and/or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the exemplary embodiments presented below can be combined in any combination of ways, i.e., any element from one exemplary embodiment can be used in any other exemplary embodiment, without departing from the scope of the disclosure.

The indefinite article "a" or "an", as used herein, means "at least one" unless specified to the contrary or the context clearly indicates otherwise. Thus, embodiments using "a separator" include embodiments where one or two or more separators are used, unless specified to the contrary or the context clearly indicates that only one separator is used. Likewise, embodiments using "a separation stage" include embodiments where one or two or more separation stages are used, unless specified to the contrary.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

As used herein, the term "hydrocarbon" means a class of compounds containing hydrogen bound to carbon. The term "$C_n$" hydrocarbon means hydrocarbon having n carbon atom(s) per molecule, where n is a positive integer. The term "$C_{n+}$" hydrocarbon means hydrocarbon having at least n carbon atom(s) per molecule, where n is a positive integer. The term "$C_{n-}$" hydrocarbon means hydrocarbon having no more than n number of carbon atom(s) per molecule, where n is a positive integer. "Hydrocarbon" encompasses (i) saturated hydrocarbon, (ii) unsaturated hydrocarbon, and (iii) mixtures of hydrocarbons, including mixtures of hydrocarbon compounds (saturated and/or unsaturated), including mixtures of hydrocarbon compounds having different values of n.

As used herein, the term "hydrocarbon feed" means any feed that includes hydrocarbon and is suitable for producing $C_{2+}$ unsaturated hydrocarbons, e.g., ethylene and/or propylene, by pyrolysis, such as by steam cracking. Typical hydrocarbon feeds include ≥10% hydrocarbon (weight basis, based on the weight of the hydrocarbon feed), e.g., ≥50%, such as ≥90%, or ≥95%, or ≥99%.

Figure 2:
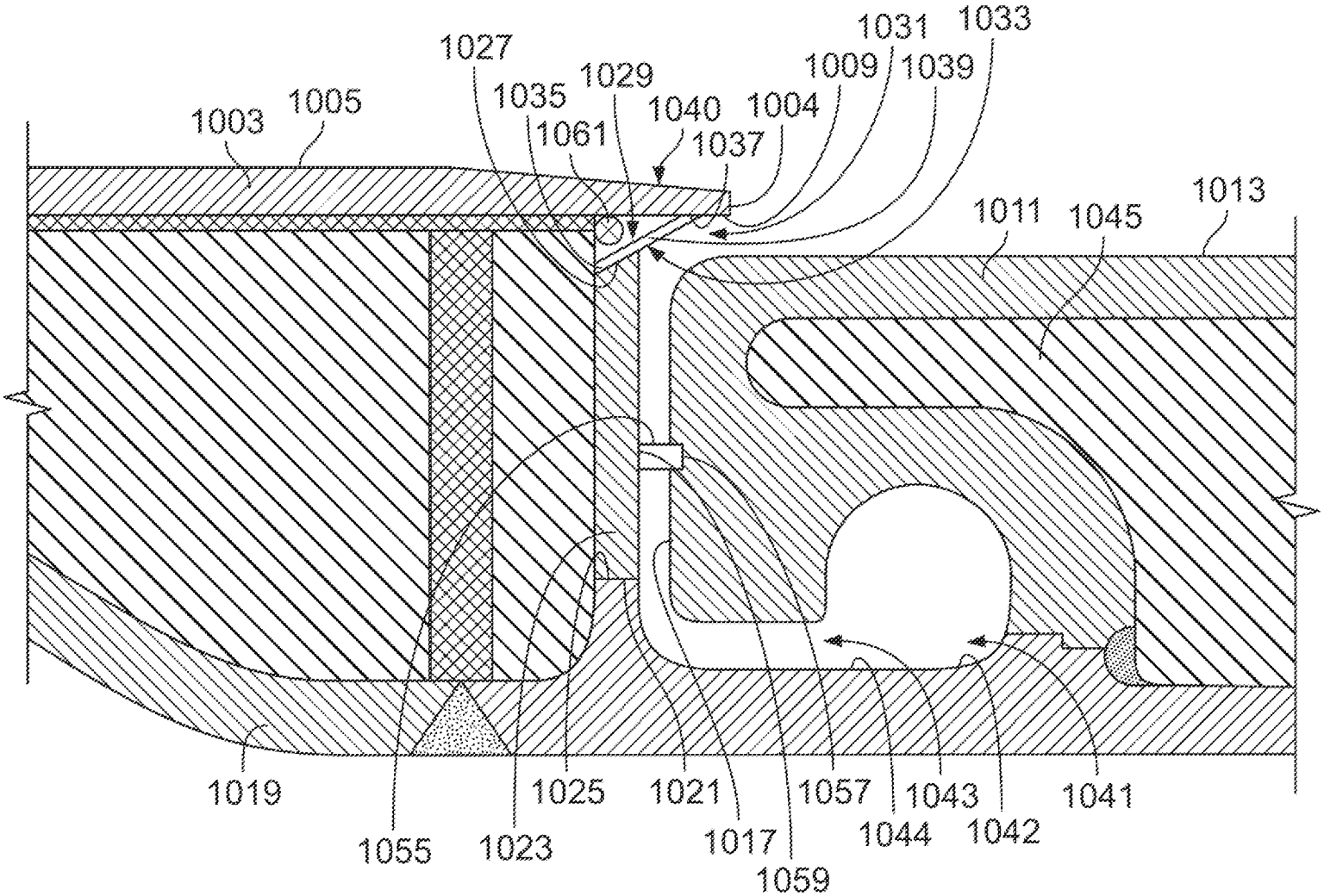
FIG. 2 depicts a close-up cross-section view of a wet slip-joint of the conduit shown in FIG. 1.
Figure 3:
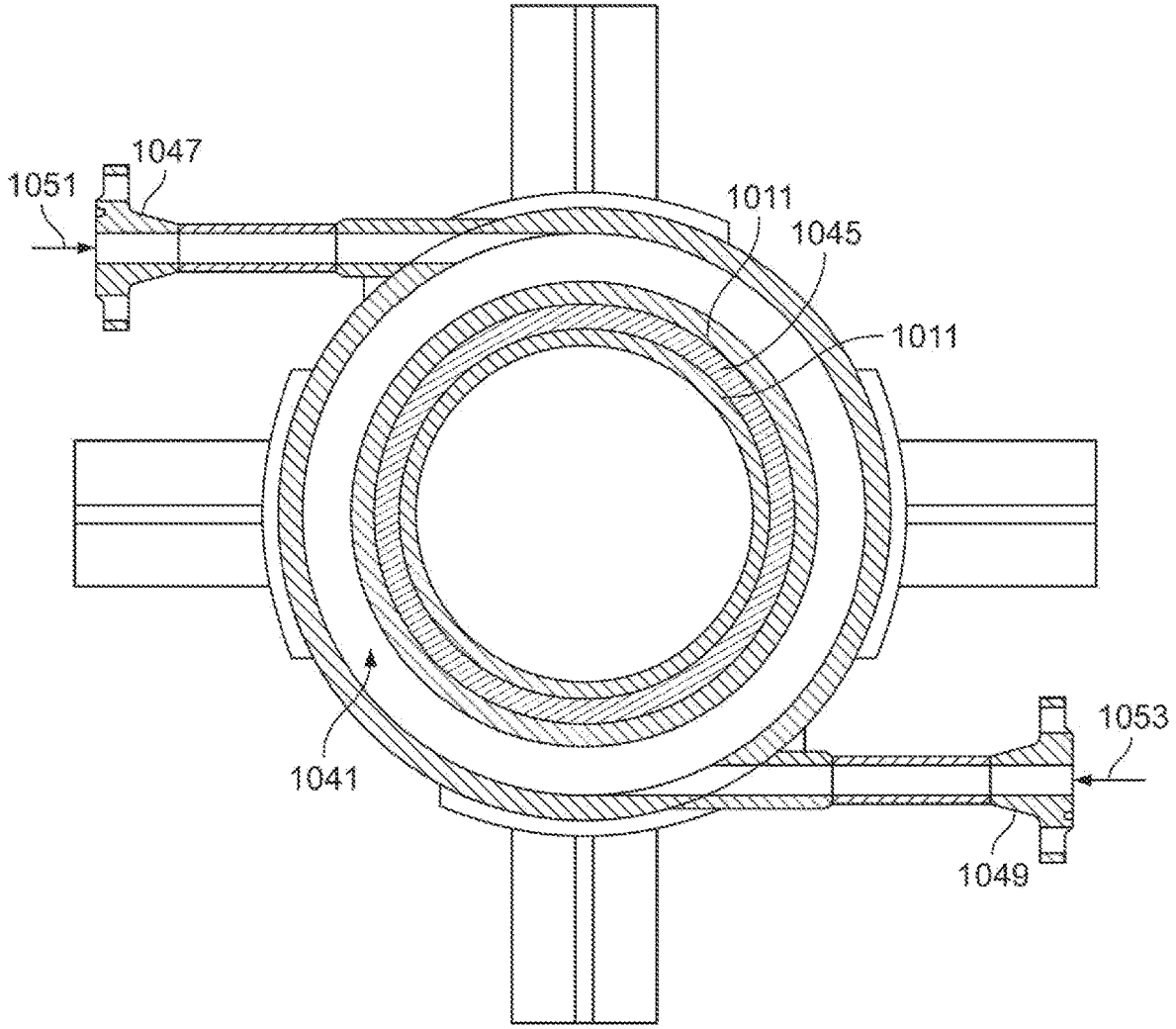
FIG. 3 depicts a cross-section view of the conduit shown in FIG. 1 along section line 3-3.

FIG. 1 depicts a longitudinal cross-section view of a conduit 100 for cooling a hydrocarbon gas-containing stream in line 1001, according to one or more embodiments. FIG. 2 depicts a close-up cross-section view of a wet slip-joint 1040 of the conduit 100 shown in FIG. 1. FIG. 3 depicts a cross-section view of the conduit 100 shown in FIG. 1 along section line 3-3. In some embodiments, the hydrocarbon gas-containing stream in line 1001 can be recovered directly from a hydrocarbon pyrolysis furnace (not shown) such as a steam cracker furnace. In other embodiments, the hydrocarbon gas-containing stream in line 1001 can be recovered from an indirect heat exchanger that can be used to initially cool cracked effluent recovered directly from a hydrocarbon pyrolysis furnace (not shown). As such, the conduit 100 can be used as a primary cooling device or as a secondary cooling device.

Referring to FIGS. 1-3, the conduit 100 can include a first inner wall 1003, a second inner wall 1011, and an outer wall 1019 disposed about the first inner wall 1003 and the second inner wall 1011. The first inner wall 1003 can have a first inner surface 1005 that can define a first bore 1007 therethrough. The second inner wall 1011 can have a second inner surface 1013 that can define a second bore 1015 therethrough. The first bore 1007 can be in fluid communication with the second bore 1015 such that the hydrocarbon gas-containing stream can be introduced via line 1001 into the first bore 1007, flow through the first bore 1007, and can flow into the second bore 1015. A cross-sectional area of the first bore 1007 in a plane perpendicular to a longitudinal axis of the first bore 1007 can be less than a cross-sectional area of the second bore 1015 in a plane perpendicular to a longitudinal axis of the second bore 1015.

The conduit 100 can also include one or more annular support walls (one is shown, 1023) that can include a first end 1025 and a second end 1027. The first end 1025 of the annular support wall 1023 can be connected to an inner surface 1021 of the outer wall 1019 and the second end 1027 of the annular support wall 1023 can be proximate to an outer surface 1009 of the first inner wall 1003 such that an annular gap 1029 is formed between the second end 1027 of the annular support wall 1023 and the outer surface 1009 of the first inner wall 1003. A first end 1017 of the second inner wall 1011 and the second end 1027 of the annular support wall 1023 can define a perimeter opening 1031 that can be in fluid communication with the second bore 1015. As shown, in some embodiments, the second end 1027 of the annular support wall 1023 can be angled with respect to a longitudinal axis of the second bore 1015 such that the edge or corner closest to the first end 1017 of the second inner wall 1011 is closer to the outer surface 1009 of the first inner wall 1003 than the edge or corner of the annular support wall 1023 that is furthest from the first end 1017 of the second inner wall 1011.

The conduit 100 can also include one or more annular flexible rings (one is shown 1033). The annular flexible ring 1033 can have an outer perimeter 1035, an inner perimeter 1037, and a continuous ring wall 1039 between the outer perimeter 1035 and the inner perimeter 1037. In some embodiments, the outer edge or perimeter 1035 of the annular flexible ring 1033 can be bonded, e.g., welded, to the second end 1027 of the annular support wall 1023. The inner edge or perimeter 1037 of the annular flexible ring 1033 can flexibly contact the outer surface 1009 of the first inner wall 1003 without forming a permanent mechanical bond with the first inner wall 1003. By not forming a permanent mechanical bond between the first inner perimeter 1037 of the annular flexible ring 1033 and the outer surface 1009 of the first inner wall 1003, the first inner wall 1003 can be permitted to change dimensions both radially and axially with respect to a longitudinal axis of the first bore 1007. For example, during operation, the hydrocarbon gas-containing stream that can be introduced via line 1001 can be at a sufficiently high temperature that can, upon introduction into the first bore 1007, cause the first inner wall 1003 to thermally expand radially and/or axially with respect to the longitudinal axis of the first bore 1007. As the first inner wall 1003 expands radially the outer surface 1009 of the first inner wall 1003 can contact and slightly deform the inner perimeter 1037 of the annular flexible ring 1033 to form a liquid seal therebetween. The liquid seal formed between the inner perimeter 1037 of the annular flexible ring 1033 and the outer surface 1009 of the first inner wall can be effective to inhibit or prevent the quench fluid flowing through the perimeter opening 1031 during operation to flow therebetween. When introduction of the hydrocarbon gas-containing stream via line 1001 is stopped, the first inner wall 1003 can begin to cool and shrink radially and/or axially with respect to the longitudinal axis of the first bore 1007.

As shown, in some embodiments, a cross-section of the ring wall 1039 of the annular flexible ring 1033 can be angled relative to a longitudinal axis of the second bore 1015. As shown, in some embodiments, the cross-section of the ring wall 1039 of the annular flexible ring 1033 can be angled relative to a longitudinal axis of the second bore 1015 such that the inner perimeter 1037 of the annular flexible ring 1033 can be located closer to the second wall 1011 than the outer perimeter 1035 of the annular flexible ring 1033.

In some embodiments, the annular flexible ring 1033 can be composed of an austenitic stainless steel. Suitable austenitic stainless steels can include 310 or 310S stainless steel or nickel-chromium-iron alloys such as those sold under the tradenames of INCONEL® 601, INCOLOY® 800H, or the like. In some embodiments, the conduit 100 can include 1, 2, 3, 4, or more annular flexible rings 1033. In some embodiments, when the conduit 100 includes multiple annular flexible rings 1033, the annular flexible rings 1033 can be placed in abutting contact or otherwise stacked together. In other embodiments, when the conduit 100 includes multiple annular flexible rings 1033, the annular flexible rings 1033 can be spaced apart with respect to one another. For example, a thickness of the annular support wall 1023 can be greater and have multiple angled grooves along the second end 1027 thereof to which the annular flexible rings 1033 can be bonded thereto in a spaced apart manner. In still other embodiments, when the conduit 100 includes multiple annular flexible rings 1033, the conduit can also include multiple annular support walls 1023 that can each include one or more annular flexible rings 1033 bonded to the second end 1027 thereof. In some embodiments, when the conduit 100 includes multiple annular flexible rings 1033 the diameter of the annular flexible rings 1033 and the length of the continuous ring walls 1039 between the outer perimeter 1035 and the inner perimeter 1037 can be the same or different with respect to one another. In some embodiments, when the conduit 100 includes multiple annular flexible rings 1033 a thickness of the annular flexible rings 1033 can be the same or different with respect to one another.

The conduit 100 can also include a substantially annular cavity 1041 disposed between the second inner wall 1011 and the outer wall 1019. The annular cavity 1041 can be in fluid communication with the perimeter opening 1031 via a peripheral channel 1043. In some embodiments, a refractory material 1045 can disposed within the second inner wall 1011 between the annular cavity 1041 and the second inner surface 1013 of the second inner wall 1011. The refractory material 1045 can provide a thermal barrier to reduce the amount of heat transferred into the annular cavity 1041 from the inner surface 1013 of the second inner wall 1011 as the hydrocarbon gas-containing stream in line 1001 flows through the second bore 1015. In some embodiments, the refractory material 1045 can primarily be or can primarily include, but is not limited to, one or more oxides such as aluminum oxide, silicon dioxide, or the like. In some embodiments, suitable refractory materials 1045 can include those sold by Thermbond Refractories such as THERMBOND® 6P.

In some embodiments, the cross-sectional shape of the annular cavity 1041 can be shaped as a substantially toroidal-shaped channel, notch, or slot. It should be understood, however, that the cross-sectional shape of the annular cavity 1041 is not generally critical and may be for example, rounded, include a substantially flat wall, or shaped as an elongated slot, so long as the quench fluid can be sufficiently dispersed throughout the annular cavity 1041. In other embodiments, the annular cavity 1041 can be substantially the same component as the peripheral channel 1043 or essentially the same or similar size and shape or geometry as the peripheral channel 1043, such that it becomes difficult to distinguish where the annular cavity 1041 ends and the peripheral channel 1043 begins.

In some embodiments, the annular cavity 1041 can provide at least as much volumetric capacity and preferably at least twice as much volumetric capacity, as the capacity of the peripheral channel 1043, such that the annular cavity 1041 provides a quench fluid supply reservoir that uniformly provides quench fluid to the peripheral channel 1043 with minimal pressure differential, around the full circumference of the second inner surface 1013 of the second inner wall 1011. The volumetric capacity of the annular cavity 1041 can also provide capacity for dissipation of any inertial introduction energy from the quench fluid introduced into the annular cavity 1041, whether by tangential, oblique, or perpendicular introduction of quench fluid into the annular cavity 1041 is used, although tangential is preferred to facilitate uniform filling of the annular cavity 1041. As such, the quench fluid can be introduced through the peripheral channel 1043 and onto the second inner surface 1013 of the second inner wall 1011 in a controlled, substantially uniform fashion that can reduce or avoid spraying or otherwise dispersing the quench fluid into the second bore 1013.

The conduit can also include at least one quench fluid introduction port (two are shown, 1047, 1049) (see FIG. 3) configured to introduce the quench fluid into the annular cavity 1041. In some embodiments, the quench fluid introduction port(s) 1047, 1049 can be configured to introduce the quench fluid tangentially into the annular cavity 1041. In some embodiments, the conduit can include 1, 2, 3, 4, or more fluid introduction ports. In some embodiments, when the conduit 100 includes at least two quench fluid introduction ports 1047, 1049, each quench fluid introduction port can be spaced substantially evenly about a circumference of the outer wall 1019 with respect to one another. For example, when the conduit 100 includes the two quench fluid introduction ports 1047, 1049, each of the two quench fluid introduction ports can be positioned about 180 degrees apart from the other and each oriented to tangentially deliver the quench fluid in the same direction as the other respective introduction port. As such, the quench fluid can be introduced into the annular cavity in a common direction of rotation about the hydrocarbon gas-containing stream flowing through the second bore 1015.

The quench fluid can be introduced via line 1051 into quench fluid introduction port 1047 and via line 1053 into quench fluid introduction port 1049. In some embodiments, the quench fluid can be a liquid when introduced into the second bore via the perimeter opening 1031. In some embodiments, the quench fluid can be a liquid hydrocarbon. Suitable quench fluids can be or can include, but are not limited to, a distillate oil and more preferably an aromatic-containing distillate oil. In some embodiments, the quench fluid can have a final boiling point of at least 400° C. In some embodiments, the quench fluid can be or can include, but is not limited to, an aromatic distillate separated from the cooled hydrocarbon gas-containing stream introduced via line 1001 into the conduit 100. In some embodiments, the quench fluid can be substantially free or free of tar precursors. In some embodiments, the quench fluid in lines 1051 and 1053 can be introduced into the annular cavity 1041 as a function of at least one of (i) the rate at which a hydrocarbon feed is supplied to a pyrolysis furnace that produces the hydrocarbon gas-containing stream in line 1001, and/or (ii) the temperature of the cooled gaseous effluent recovered from the conduit 100.

When the quench fluid introduction ports are configured to introduce the quench fluid tangentially into the annular cavity 1041, the quench fluid energy can be dissipated along an outer wall 1042 of the annular cavity 1041 to centrifugally fill the annular cavity 1041. In addition to containing the quench fluid within the annular cavity 1041, the outer wall 1042 of the annular cavity 1041 can function to facilitate pressurized displacement of the quench fluid through the peripheral channel 1043 and onto the second inner surface 1013 of the second inner wall 1011. In some embodiments, the peripheral channel 1043 can emanate from a portion of the annular cavity 1041 that is substantially parallel with the outer wall 1042, such that the outer wall 1042 of the annular cavity 1041 is substantially parallel or flush with an outer wall 1044 of the peripheral channel 1043, e.g., 1042 and 1044 can have the same or substantially the same outer diameter with respect to the longitudinal center axis of the second bore 1015. In such embodiment, quench fluid leaving the annular cavity 1041 does not have to overcome the centrifugal force of the quench fluid that is tangentially introduced into the annular cavity 1041. However, the peripheral channel 1043 can also emanate from other portions of the annular cavity 1041, such as a medial portion of the annular cavity 1041.

An end 1004 of the first inner wall 1003 can extend past the inner perimeter 1037 of the annular flexible ring 1033. In some embodiments, the end 1004 of the first inner wall 1003 can also extend past the perimeter opening 1031 and into the second bore 1015. In some embodiments, the annular flexible ring 1033 and a portion of the outer surface 1009 of the first inner wall 1003 can be configured to direct and distribute the quench fluid onto the second inner surface 1013 of the second inner wall 1011. In some embodiments, the quench fluid that can flow through the perimeter opening 1031 and onto the second inner surface 1013 of the second inner wall 1011 can be distributed substantially uniformly and substantially circumferentially around the second inner surface 1013 of the second inner wall 1011. As noted above, the contact between the inner perimeter 1037 of the annular flexible ring 1033 and the outer surface 1009 of the first inner wall 1003 can be sufficient to prevent quench fluid from flowing between the inner perimeter 1037 of the annular flexible ring 1033 and the outer surface 1009 of the first inner wall 1003. The arrangement of the annular flexible ring 1033 being in contact with the outer surface 1009 of the first inner wall 1003 such that the quench fluid flushes the slip-joint, i.e., where the inner perimeter 1037 of the annular flexible ring 1033 contacts the outer surface 1009 of the inner wall 1003, and the quench fluid flows through the perimeter opening 1031 can be referred to as the wet slip-joint identified generally via reference number 1040. The arrangement of the annular flexible ring 1033 being in contact with the outer surface 1009 of the first inner wall 1003 is referred to as a "wet slip-joint" or simply "slip-joint" because the arrangement enables conduit 1003 to "slip" past conduit 1011 with minimal or no restriction. It is believed that by constantly flushing the slip-joint with the quench fluid during cooling of the hydrocarbon gas-containing stream that the build-up of coke within the wet slip-joint 1040 can be significantly inhibited if not entirely prevented.

In some embodiments, the peripheral channel 1043 can be of substantially any shape but preferably can be a peripheral gap or slot type of aperture or either uniformly tapered or relatively constant gap width, with respect to the radially inward direction from the outer wall 1044 to the perimeter opening 1031. In some embodiments, the peripheral channel 1043 can provide at least some hydraulic resistance or impedance to flow of the quench fluid from the annular cavity 1041 to the perimeter opening 1031. The amount of hydraulic resistance need not be great, but merely only enough to discourage premature or nonuniform liquid quench fluid loss from the annular cavity 1041 into the second bore 1015. For example, the hydraulic resistance can be sufficient to provide enough impedance to facilitate uniform distribution and substantially uniform pressurization of the quench fluid within the full length of the annular cavity 1041, which can be subsequently followed by substantially uniform emission of the quench fluid from the annular cavity 1041 through the peripheral channel 1043 and onto the second inner surface 1013 of the second inner wall 1011. The exact shape or flow path direction of the peripheral channel 1043 from the annular cavity 1041 to the perimeter opening 1031 is not critical and can be substantially curved, flat, linear, or include angled flow paths, such as the substantially right angled flow path illustrated in FIGS. 1 and 2. The sum of the first and second flow components preferably result in a resultant hydraulic flow path that can be substantially linear from the annular cavity 1041 to the perimeter opening 1031 or curvilinear if the flow path is tapered or otherwise has hydraulic variance along its length.

In some embodiments, the conduit 100 can also include one or more spacer pins 1055 disposed within the peripheral channel 1043. As shown, a first end 1057 the spacer pin can be bonded, e.g., welded, to the first end 1017 of the second inner wall 1011. The second end 1059 of the spacer pin 1055 can be proximate the annular support wall 1023 or in contact with the annular support wall 1023 but can be mechanically unconnected thereto. The spacer pin 1055 can ensure that the annular inner wall 1023 and the first end 1017 of the second inner wall 1011 cannot move relative to one another in such a way that can close off the perimeter opening 1031. In other embodiments, the second end 1059 of the spacer pin 1055 can be bonded, e.g., welded, to the annular support wall 1023 and the first end 1057 of the spacer pin 1055 can be proximate the first end 1017 of the second inner wall 1011 or in contact with the first end 1017 of the second inner wall 1011 but can be mechanically unconnected thereto.

In some embodiments, the conduit 100 can also include one or more annular expansion gaskets 1061 disposed between the annular flexible ring 1033 and the outer surface 1009 of the first inner wall 1003. In some embodiments, the conduit 100 can include 1, 2, 3, 4, or more annular expansion gaskets 1061. In some embodiments, the annular expansion gasket can be a braided silica rope covered in a sleeve formed from ceramic fibers. Suitable annular expansion gaskets 1061 can include the ARMORTEC® gaskets available from INTEC Products, Inc.

Process for Quenching a Hydrocarbon

In some embodiments, a process for quenching a hydrocarbon gas-containing stream can include introducing the hydrocarbon gas-containing stream via line 1001 into the first bore 1007 of the cooling conduit 100. The quench fluid via lines 1051 and 1053 can be introduced, e.g., tangentially, into the substantially annular cavity 1041 via the quench fluid introduction ports 1047 and 1049, respectively. The quench fluid can flow through the peripheral channel 1043 to the perimeter opening 1031. The quench fluid can be distributed from the perimeter opening 1031 onto the second inner surface 1013 of the second inner wall 1011. The hydrocarbon gas-containing stream can flow from the first bore 1007 into the second bore 1015. The hydrocarbon gas-containing stream can be contacted with the quench fluid within the second bore 1015 to produce a cooled effluent. The hydrocarbon gas-containing stream in line 1001 can be produced by introducing a hydrocarbon feed into a pyrolysis furnace operating under pyrolysis conditions.

As noted above, in some embodiments, the end 1004 of the first inner wall 1003 can extend past the inner perimeter 1037 of the annular flexible ring 1033, past the perimeter opening 1031, and into the second bore 1015 such that the annular flexible ring 1033 and a portion of the outer surface 1009 of the first inner wall 1003 can form the wet slip-joint 1040 and can inject, direct, distribute, or otherwise introduce the quench fluid onto the second inner surface 1013 of the second inner wall 1011. In some embodiments, by introducing the quench fluid through tangential inlets, a rotational flow can be established, and the resulting centrifugal force can help keep/introduce the quench fluid on the inner surface 1013 of the conduit 1011 after the quench fluid passes through the perimeter opening 1031. In some embodiments, the quench fluid introduced via lines 1051 and 1053 can be or can include one or more aromatic hydrocarbons that can have a final boiling point of ≥400° C. In some embodiments, the quench fluid can be or can include an aromatic distillate separated from the cooled effluent.

As noted above, in some embodiments, the conduit 100 can be used as a primary or sole apparatus to cool the hydrocarbon gas-containing stream. In such application the hydrocarbon gas-containing stream can be at a temperature in a range of from 750° C., 775° C., 800° C., or 825° C. to 875° C., 900° C., 925° C., 950° C., or greater. The cooled effluent recovered from the conduit 100 can be at a temperature in a range of from 250° C., 260° C., 270° C., or 280° C. to 290° C., 300° C., 310° C., or 320° C. When the conduit 100 is used as the primary or sole apparatus to cool the hydrocarbon gas-containing stream, a weight ratio of the quench fluid to the hydrocarbon feed introduced into the pyrolysis furnace can be in a range of from 2, 2.5, or 3 to 3.5, 4, or 4.5 such as 2.5 to 4.

In other embodiments, the conduit 100 can be used as a secondary apparatus to cool the hydrocarbon gas-containing stream. For example, the hydrocarbon gas-containing stream can be recovered from an indirect heat exchanger that can cool the pyrolysis effluent from a temperature in a range of from 750° C. to 950° C. to produce the hydrocarbon gas-containing stream in line 1001 that can have a temperature in a range of from 460° C., 500° C., or 550° C. to 600° C., 650° C., or 705° C. When the conduit 100 is used as a secondary apparatus to cool the hydrocarbon gas-containing stream, the cooled effluent recovered from the conduit 100 can also be at a temperature in a range of from 250° C., 260° C., 270° C., or 280° C. to 290° C., 300° C., 310° C., or 320° C. When the conduit 100 is used a secondary apparatus to cool the hydrocarbon gas-containing stream, a weight ratio of the quench fluid to the hydrocarbon feed introduced into the pyrolysis furnace can be in a range of from 0.5, 0.8, or 1 to 1.5, 2, or 2.5 such as 0.8 to 2.5.

In some embodiments, a flow rate of the quench fluid introduced via lines 1051 and 1053 into the substantially annular cavity 1041 of the conduit 100 can be based, at least in part, on a flow rate the hydrocarbon feed is introduced into the pyrolysis furnace. In other embodiments, the flow rate of the quench fluid introduced via lines 1051 and 1053 into the substantially annular cavity 1041 of the conduit 100 can be based, at least in part, on a temperature of the cooled effluent.

In some embodiments, during cooling of the hydrocarbon gas-containing stream introduced via line 1001 into the conduit 100, the first inner surface 1005 of the first inner wall 1003 can be at a temperature of ≥500° C., ≥650° C., ≥700° C., ≥750° C., or ≥800° C. The inner surface 1042 of the annular cavity 1041 can be at a temperature of ≤300° C., ≤250° C., or ≤200° C. The second inner surface 1013 of the second inner wall 1011 can be at a temperature in a range of from 200° C., 225° C., or 250° C. to 300° C., 350° C., or 400° C. The temperature of the second inner surface 1013 of the second inner wall 1011 can be greater than the temperature of the inner surface 1042 of the annular cavity and the inner surface 1021 of the peripheral channel 1043.

In some embodiments, during cooling of the hydrocarbon gas-containing stream introduced via line 1001, the conduit 100 can be oriented substantially vertical with respect to a ground surface such that the hydrocarbon gas-containing stream flows downward through the first bore 1007 and the second bore 1015 and the quench fluid flows downward through the second bore 1015.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A conduit for cooling a hydrocarbon gas-containing stream, comprising:

(i) a first inner wall having a first inner surface defining a first bore therethrough, a second inner wall having a second inner surface defining a second bore therethrough, and an outer wall disposed about the first inner wall and the second inner wall;

(ii) an annular support wall having a first end connected to an inner surface of the outer wall and a second end that is proximate to an outer surface of the first inner wall such that an annular gap is formed between the second end of the annular support wall and the outer surface of the first inner wall, wherein a first end of the second inner wall and the second end of the annular support wall define a perimeter opening in fluid communication with the second bore;

(iii) an annular flexible ring having an outer perimeter, an inner perimeter, and a continuous ring wall between the outer perimeter and the inner perimeter, wherein the outer perimeter is bonded to the second end of the annular support wall, wherein the inner perimeter flexibly contacts the outer surface of the first inner wall without forming a permanent mechanical bond with the first inner wall, thereby permitting the first inner wall to thermally change dimensions both radially and axially with respect to a longitudinal axis of the first bore, and wherein an end of the first inner wall extends past the inner perimeter of the annular flexible ring;

(iv) a substantially annular cavity disposed between the second inner wall and the outer wall, wherein the annular cavity is in fluid communication with the perimeter opening via a peripheral channel; and (v) at least one quench fluid introduction port configured to introduce a quench fluid into the annular cavity.

2. The conduit of claim 1, wherein the end of the first inner wall extends past the perimeter opening and into the second bore.

3. The conduit of claim 1, wherein the annular flexible ring and a portion of the outer surface of the first inner wall are configured to distribute the quench fluid onto the inner surface of the second inner wall.

4. The conduit of claim 1, wherein a cross-section of the ring wall of the annular flexible ring is angled relative to a longitudinal axis of the second bore.

5. The conduit of claim 1, wherein a cross-section of the ring wall of the annular flexible ring is angled with respect to the longitudinal axis of the second bore such that the inner perimeter of the annular flexible ring is located closer to the second wall than the outer perimeter of the annular flexible ring.

6. The conduit of claim 1, wherein the at least one quench fluid introduction port is configured to introduce the quench fluid tangentially into the annular cavity.

7. The conduit of claim 1, wherein the conduit comprises at least two annular flexible rings, wherein the outer perimeters of the at least two annular flexible rings are bonded to the second end of the annular support wall, and wherein the inner perimeters of the at least two annular flexible rings flexibly contact the outer surface of the first inner wall without forming a permanent mechanical bond with the first inner wall.

8. The conduit of claim 1, wherein a cross-sectional area of the first bore in a plane perpendicular to the longitudinal axis of the first bore is less than a cross-sectional area of the second bore in a plane perpendicular to the longitudinal axis of the second bore.

9. The conduit of claim 1, wherein the conduit comprises at least two quench fluid introduction ports each configured to introduce the quench fluid into the annular cavity.

10. The conduit of claim 9, wherein the at least two quench fluid introduction ports are spaced substantially evenly about a circumference of the outer wall with respect to one another.

11. The conduit of claim 1, wherein the outer perimeter of the annular flexible ring is welded to the second end of the annular support wall.

12. The conduit of claim 1, further comprising (vi) at least one spacer pin disposed within the peripheral channel, wherein a first end the spacer pin is bonded to the first end of the second inner wall, and wherein a second end of the spacer pin is proximate or in contact with the annular support wall such that the annular support wall and spacer pin are free to move with respect to one another.

13. The conduit of claim 1, wherein the annular flexible ring is composed of an austenitic stainless steel.

14. The conduit of claim 1, further comprising (vii) at least one annular expansion gasket disposed between the annular flexible ring and the outer surface of the first inner wall.

15. The conduit of claim 14, wherein the annular expansion gasket comprises a braided silica rope covered in a sleeve formed from ceramic fibers.

16. The conduit of claim 1, wherein a surface of the annular support wall opposed to the first end of the second inner wall is flat.

17. A process for quenching a hydrocarbon gas-containing stream, comprising:

(I) introducing the hydrocarbon gas-containing stream into a first bore of a cooling conduit, wherein the cooling conduit comprises:

(i) a first inner wall having a first inner surface defining the first bore therethrough, a second inner wall having a second inner surface defining a second bore therethrough, and an outer wall disposed about the first inner wall and the second inner wall;

(ii) an annular support wall having a first end connected to an inner surface of the outer wall and a second end that is proximate to an outer surface of the first inner wall such that an annular gap is formed between the second end of the annular support wall and the outer surface of the first inner wall, wherein a first end of the second inner wall and the second end of the annular support wall define a perimeter opening in fluid communication with the second bore;

(iii) an annular flexible ring having an outer perimeter and an inner perimeter and a continuous ring wall between the outer perimeter and the inner perimeter, wherein the outer perimeter is bonded to the second end of the annular support wall, wherein the inner perimeter flexibly contacts the outer surface of the first inner wall without forming a permanent mechanical bond with the first inner wall, thereby permitting the first inner wall to thermally change dimensions both radially and axially with respect to a longitudinal axis of the first bore, and wherein an end of the first inner wall extends past the inner perimeter of the annular flexible ring;

(iv) a substantially annular cavity disposed between the second inner wall and the outer wall, wherein the annular cavity is in fluid communication with the perimeter opening via a peripheral channel; and (v) at least one quench fluid introduction port configured to introduce a quench fluid into the annular cavity;

(II) introducing a quench fluid into the substantially annular cavity via the at least one quench fluid introduction port;

(III) flowing the quench fluid through the peripheral channel to the perimeter opening;

(IV) distributing the quench fluid from the perimeter opening onto the second inner surface of the second inner wall;

(V) flowing the hydrocarbon gas-containing stream from the first bore into the second bore; and (VI) contacting the hydrocarbon gas-containing stream with the quench fluid within the second bore to produce a cooled effluent.

18. The process of claim 17, wherein the quench fluid comprises a liquid hydrocarbon.

19. The process of claim 17, wherein the cooling conduit is substantially vertical with respect to a ground surface such that the hydrocarbon gas-containing stream flows downward through the first and second bores and the quench fluid flows downward through the second bore.

20. The process of claim 17, further comprising (VII) controlling a flow rate of the quench fluid introduced into the substantially annular cavity based, at least in part, on a temperature of the cooled effluent.

21. The process of claim 17, wherein the end of the first inner wall extends past the perimeter opening and into the second bore such that the annular flexible ring and a portion of the outer surface of the first inner wall form a wet slip-joint that distributes the quench fluid onto the inner surface of the second inner wall.

22. The process of claim 17, wherein the outer surface of the first inner wall thermally expands radially with respect to a longitudinal axis of the first bore such that the outer surface of the first inner wall deforms the inner perimeter of the annular flexible ring to form a liquid seal there between.

23. A conduit for cooling a hydrocarbon gas-containing stream, comprising:

(i) a first inner wall having a first inner surface defining a first bore therethrough, a second inner wall having a second inner surface defining a second bore therethrough, and an outer wall disposed about the first inner wall and the second inner wall;

(ii) an annular support wall having a first end connected to an inner surface of the outer wall and a second end that is proximate to an outer surface of the first inner wall such that an annular gap is formed between the second end of the annular support wall and the outer surface of the first inner wall, wherein a first end of the second inner wall and the second end of the annular support wall define a perimeter opening in fluid communication with the second bore;

(iii) an annular flexible ring having an outer perimeter, an inner perimeter, and a continuous ring wall between the outer perimeter and the inner perimeter, wherein the outer perimeter is bonded to the second end of the annular support wall, wherein the inner perimeter flexibly contacts the outer surface of the first inner wall without forming a permanent mechanical bond with the first inner wall, thereby permitting the first inner wall to thermally change dimensions both radially and axially with respect to a longitudinal axis of the first bore, and wherein the annular flexible ring and a portion of the outer surface of the first inner wall are configured to distribute the quench fluid onto the inner surface of the second inner wall;

(iv) a substantially annular cavity disposed between the second inner wall and the outer wall, wherein the annular cavity is in fluid communication with the perimeter opening via a peripheral channel; and (v) at least one quench fluid introduction port configured to introduce a quench fluid into the annular cavity.

24. The conduit of claim 23, wherein an end of the first inner wall extends past the perimeter opening and into the second bore.

25. The conduit of claim 23, further comprising at least one spacer pin disposed within the peripheral channel, wherein a first end the spacer pin is bonded to the first end of the second inner wall, and wherein a second end of the spacer pin is proximate or in contact with the annular support wall such that the annular support wall and spacer pin are free to move with respect to one another.

26. The conduit of claim 23, wherein a surface of the annular support wall opposed to the first end of the second inner wall is flat.

27. The conduit of claim 23, further comprising at least one annular expansion gasket disposed between the annular flexible ring and the outer surface of the first inner wall.

28. The conduit of claim 27, wherein the annular expansion gasket comprises a braided silica rope covered in a sleeve formed from ceramic fibers.

* * * * *